United States Patent [19]

Doering

[11] Patent Number: 4,611,657

[45] Date of Patent: Sep. 16, 1986

[54] PITLESS ADAPTOR BY-PASS

[76] Inventor: Garry L. Doering, Box 1469, Olds, Alberta, Canada, T0M 1P0

[21] Appl. No.: 674,110

[22] Filed: Nov. 21, 1984

[51] Int. Cl.[4] ..... E21B 43/00

[52] U.S. Cl. ..... 166/88; 166/115

[58] Field of Search ..... 166/85, 88, 89, 115

[56] References Cited

U.S. PATENT DOCUMENTS

| | | | |
|---|---|---|---|
| 2,689,611 | 9/1954 | Martinson | 166/89 |
| 3,380,533 | 4/1968 | Andrew | 166/88 |
| 3,605,886 | 9/1971 | Cox et al. | 166/89 |
| 3,721,296 | 3/1973 | Tubbs | 166/88 |
| 4,298,065 | 11/1981 | Baski | 166/88 |

*Primary Examiner*—Stephen J. Novosad

*Attorney, Agent, or Firm*—William R. Hinds

[57] ABSTRACT

A bypass for a pitless adapter of the type including a body containing a 90 degree passage for diverting water in a well casing from a vertical drop pipe to a horizontal service line includes a pair of similar manifolds for mounting above and below the adapter body and a bypass tube. The lower manifold has a Y-shaped passage for feeding water either to the adapter or to the bypass tube. The upper manifold includes a single inlet for receiving water from the bypass tube and an outlet for discharging water to a pipe connecting the bypass to a frost free hydrant at the top end of the well casing.

8 Claims, 2 Drawing Figures

PITLESS ADAPTOR BY-PASS

BACKGROUND OF THE INVENTION

This invention relates to a pitless adapter and in particular to a bypass for a pitless adapter.

Pitless adapters are used in wells for removing water laterally from the casing below the frost line. Conventional pitless adapters are disclosed by U.S. Pat. No. 2,689,611 issued to M. B. Martinson on Sept. 21, 1954; U.S. Pat. No. 2,841,223 issued to H. W. Maas et al on July 1, 1958; U.S. Pat. No. 3,721,296 issued to H. A. Tubbs on Mar. 20, 1973; U.S. Pat. No. 3,805,891 issued to N. A. Reinhard et al on Apr. 23, 1974 and U.S. Pat. No. 4,298,065 issued to H. A. Baski on Nov. 3, 1981. With each of the adapters described in these patents, water pumped up a vertical well pipe is discharged laterally through a horizontal pipe buried beneath the frost line (approximately 8 feet below ground level). The devices, which vary in complexity and efficacy, make no provision for the discharge of water from the vertical well pipe through a standard frost free hydrant at the top of the well casing above the pitless adapter.

In the past, using a conventional pitless adapter, the only manner in which water could be obtained outside of the building receiving water from the horizontal discharge pipe, was to install a frost free hydrant at some point along the discharge pipe. The hydrant is exposed to the elements of the soil when buried. Moreover, the hydrant is exposed through the drain hole intended to drain water from the hydrant to below the frost line, to all types of contamination from shallow surface water. The hydrant often becomes plugged or damaged by sand or silt washed into the hydrant through the drain hole.

The object of the present invention is to overcome the above-mentioned deficiency in conventional pitless adapters, by providing a relatively simple bypass for use with such adapters, to provide water above the pitless adapters, i.e. at the head of the well.

BRIEF SUMMARY OF THE INVENTION

Accordingly, the present invention relates to a bypass for a pitless adapter of the type including a body containing a 90 degree passage for diverting water in a well casing from a vertical drop pipe to a horizontal service line, said bypass comprising first manifold means for mounting between said drop pipe and said adapter body; first inlet means in said first manifold means for receiving water from said drop pipe; first outlet means in said first manifold means for discharging water into said 90 degree passage; second outlet means in said first manifold means; bypass tube means for receiving water from said second outlet means; second manifold means for mounting at the top end of said adapter body; second inlet means in said second manifold means for receiving water from said bypass tube means; and third outlet means in said second manifold means for discharging the water to a hydrant or the like at the top of the well casing.

BRIEF DESCRIPTION OF THE DRAWINGS

The invention will now be described in greater detail with reference to the accompanying drawing, which illustrates a preferred embodiment of the invention and wherein.

DESCRIPTION OF THE PREFERRED EMBODIMENTS

Figure 1:
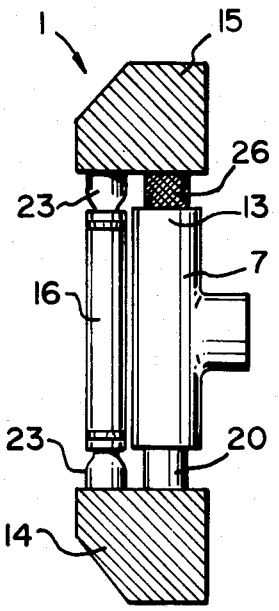
FIG. 1 is a side elevation view of a pitless adapter and a bypass in accordance with the present invention.

With reference to the drawing, a bypass in accordance with the present invention generally indicated at 1 is intended for use in a water well system of the type including a hollow casing 2 extending into the ground. A cap 3 closes the top end of the casing 2 and the top end of an electrical conduit 4. The conduit 4 also extends into the ground for providing power to the well pump (not shown). Water is pumped to a location near the surface through a drop pipe 6 in the casing 1. The water normally passes through a pitless adapter 7 to a horizontal service line 8 which is buried in the ground below the frost line. The service line 8 is connected to the casing 1 by a coupler 10, and a gasket 11 is provided between the adapter 7 and the coupler 10. The adapter 7 includes the usual inverted L-shaped, i.e. 90 degree passage 12 for carrying water from the vertical drop pipe 6 to the horizontal service line 8.

In the conventional pitless adapter of the type described in the patents mentioned hereinbefore, the top end 13 of the body of the adapter is connected to cap 3 by a pipe or rod (not shown) for stabilizing the adapter in the well casing 2. Thus, there is no means for withdrawing water through the top of the casing 2.

Figure 2:
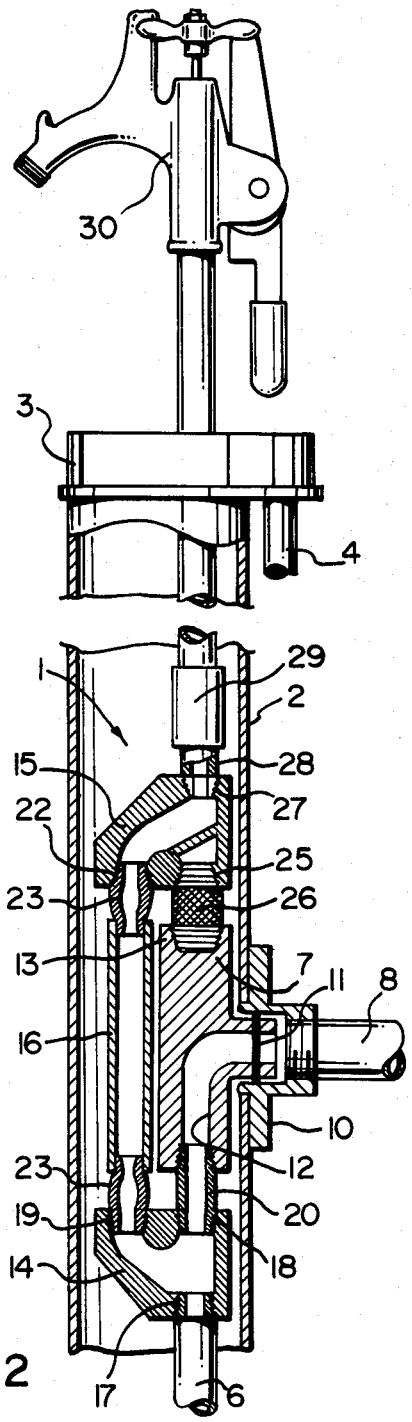
FIG. 2 is partly sectioned side view of the top end of a water well system incorporating the adapter and bypass of FIG. 1.

In accordance with the present invention the bypass 1 is used to obtain water from the adapter 7. The bypass 1 is defined by a pair of manifolds 14 and 15, and a bypass tube 16. The lower manifold 14 includes a threaded inlet passage 17 (FIG. 2) for receiving the externally threaded top end of the drop pipe 6. The passage 17 is in fluid communication with a pair of outlet passages 18 and 19. One passage 18 is connected to the passage 12 in the adapter 7 by a short length of pipe 20. The other outlet passage 19 is connected to an inlet passage 22 in the upper manifold 15 by a pair of adapters 23 and the tube 16. A second threaded aperture 25 in the bottom of the manifold 15 is used in conjunction with a short length of pipe 26, which may be blocked off, for connecting the top end 13 of the adapter 7 to the bottom of the manifold 15. An outlet passage 27, which is in fluid communication with the passage 22 is provided in the top end of the manifold 15. An adapter 28 in this embodiment, connects the top end of the manifold 15 to a frost free hydrant 30.

In operation, water normally flows up the drop pipe 6 and through the manifold 15, the pipe 20 and the adapter 7, into the horizontal service line 8. When water is required at the top of the casing 2 the hydrant 30 is operated to draw water through the bypass tube 16, the manifold 15 and the adapter 28 to the hydrant. When the hydrant 30 is no longer in operation, the water drains through drain hole 29.

What I claim is:

1. A bypass for a pitless adapter of the type including a body containing a 90 degree passage for diverting water in a well casing from a vertical drop pipe to a horizontal service line, said bypass comprising first manifold means for mounting between said drop pipe and said adapter body; first inlet means in said first manifold means for receiving water from said drop pipe; first outlet means in said first manifold means for discharging water into said 90 degree passage; second outlet means in said first manifold means; bypass tube means for receiving water from said second outlet means; second manifold means for mounting at the top end of said adapter body; second inlet means in said second manifold means for receiving water from said bypass tube means; and third outlet means in said second manifold means for discharging the water to a hydrant or the like at the top of the well casing.

2. A bypass according to claim 1 wherein first and second manifold means are substantially identical; said second manifold means including connector means for mounting the second manifold means on said adapter.

3. A bypass according to claim 2 wherein said connector means includes threaded apertures in said second manifold means and said adapter body connected by a threaded member.

4. A bypass according to claim 1 wherein each said inlet means and each said outlet means includes a threaded opening in the manifold means.

5. A bypass as claimed in claim 1 wherein said first and second manifold means include projecting portions projecting laterally beyond the lateral extent of said adapter body, said second outlet means of said first manifold means and said second inlet means of said second manifold means being located in said laterally projecting portions laterally clear of said adapter body and aligned such that said bypass tube runs alongside but clear of said adapter body.

6. A bypass as claimed in claim 1 wherein said first and second manifold means are physically separate and spaced from opposite ends of said adapter body, said first manifold means being connected with said adapter body by a pipe section threadedly connected with said first outlet means in said first manifold means and a threaded aperture in said adapter body communicating with said 90 degree passage.

7. A bypass as claimed in claim 6 wherein said second manifold means and said adapter body are connected by a threaded member extending between threaded openings in the first manifold means and the adapter body.

8. A bypass as claimed in claim 1 wherein said first and second manifold means and said bypass tube means are physically separate from and spaced from said adapter body, and are releasably connected therewith.

* * * * *